United States Patent [19]

Ruseff

[11] 4,355,510

[45] Oct. 26, 1982

[54] UNLOADING MEANS FOR FLOW-PRESSURE COMPENSATED VALVE

[75] Inventor: Walter Z. Ruseff, New Lenox, Ill.

[73] Assignee: Caterpillar Tractor Co., Peoria, Ill.

[21] Appl. No.: 261,117

[22] PCT Filed: Sep. 12, 1980

[86] PCT No.: PCT/US80/01192

§ 371 Date: Sep. 12, 1980

§ 102(e) Date: Sep. 12, 1980

[87] PCT Pub. No.: WO82/01044

PCT Pub. Date: Apr. 1, 1982

[51] Int. Cl.[3] ..... F16H 39/46

[52] U.S. Cl. ..... 60/452; 417/222

[58] Field of Search ..... 60/445-452, 60/486; 417/212, 216-222

[56] References Cited

U.S. PATENT DOCUMENTS

| | | | |
|---|---|---|---|
| 3,406,850 | 10/1968 | Hancox | 214/138 |
| 3,444,689 | 5/1969 | Budzich | 60/427 |
| 3,797,245 | 3/1974 | Hein | 60/452 |
| 4,116,587 | 9/1978 | Liesener | 60/445 X |
| 4,174,614 | 11/1979 | Dezelan | 60/451 X |

*Primary Examiner*—Carlton R. Croyle

*Assistant Examiner*—Edward Look

*Attorney, Agent, or Firm*—Phillips, Moore, Weissenberger, Lempio & Majestic

[57] ABSTRACT

A "load-plus" valve (34) is oftentimes utilized in the servo-system (20) for a variable displacement pump (11) to maintain pump discharge pressure ($P_D$) above a minimum pressure level and above a load pressure signal ($P_L$) generated in a fluid actuator (13). Valves of this type normally include a margin spring (39) for biasing a modulating spool (36) against the opposing force of pump discharge pressure ($P_D$) to maintain a constant margin over the load pressure signal ($P_L$) throughout the working range of the system. When the load pressure signal ($P_L$) exceeds a maximum pressure level, it is normally vented to tank (12), or continuously bled to tank across an orifice, resulting in horsepower losses. The control package employed in systems of this type are also somewhat bulky. The improved fluid circuit (10) of this invention employs an unloading arrangement (50/50a) in association with the above type of "load-plus" valve (34) which functions to inactivate the margin spring (39) to reduce the above margin between the pump discharge pressure ($P_D$) and load pressure signal ($P_L$) to zero in response to the load pressure signal ($P_L$) exceeding a maximum pressure level.

12 Claims, 3 Drawing Figures

UNLOADING MEANS FOR FLOW-PRESSURE COMPENSATED VALVE

DESCRIPTION

TECHNICAL FIELD

This invention relates generally to a flow-pressure compensated valve for use in a servo-system of a variable displacement pump, and more particularly to means for unloading a biasing or margin force imposed on the valve in response to the load pressure in the fluid actuator exceeding a maximum pressure level.

BACKGROUND ART

A variable displacement pump is employed in a hydraulic circuit for construction vehicles to control a fluid actuator, such as a double-acting hydraulic cylinder. The servo-system employed with such pump oftentimes includes a flow-pressure compensated or "load-plus" valve which functions to modulate a discharge pressure signal and to maintain pump discharge pressure above a minimum pressure level and also above a load-pressure signal generated in the cylinder. This type of valve is fully disclosed in U.S. Pat. No. 4,116,587, issued on Sept. 26, 1978 to Kenneth P. Liesener, and assigned to the assignee of this application.

The load-pressure signal is communicated from the fluid actuator to the "load-plus" valve to automatically control actuation of the swash plate for the pump to maintain the desired pump discharge pressure. In addition, a margin spring is employed in the valve to maintain the pump discharge pressure at a "MARGIN" above the load pressure signal. The load signal is continuously in communication with tank through an orifice which results in a loss in horsepower.

The present invention is directed to overcoming one or more of the problems as set forth above.

DISCLOSURE OF INVENTION

In one aspect of the present invention, a fluid circuit has a fluid actuator, a variable displacement pump including a control member movable between first and second displacement positions, first biasing means for urging the control member towards its first displacement position, second biasing means for urging the control member towards its second displacement position in response to a variable control pressure, first means for varying the control pressure in response to variations in the discharge pressure of the pump, second means for controlling the first means to modulate the control pressure in response to variations in a load pressure signal received from the fluid actuator, and third biasing means for applying a margin force to the first means to maintain a pressure differential between the control pressure and the load pressure signal during a predetermined range of the load pressure signal.

The improved fluid circuit further comprises unloading means for unloading the margin force in response to the load pressure signal exceeding a maximum pressure level and for inactivating the third biasing means to at least substantially equalize the pump discharge pressure and the load pressure signal in response to such unloading.

The improved fluid circuit of this invention will thus function efficiently to first establish a margin pressure during the working range of the circuit which is thereafter overridden by the unloading means when the load pressure signal exceeds a maximum pressure level. The fluid circuit is thus enabled to minimize horsepower losses by preventing needless loss of the load pressure signal which is normally vented in conventional systems and also provides that the total control package may be contained within a minimum envelope size.

BRIEF DESCRIPTION OF THE DRAWINGS

Other objects and advantages of this invention will become apparent from the following description and accompanying drawings wherein.

BEST MODE FOR CARRYING OUT INVENTION

Figure 1:
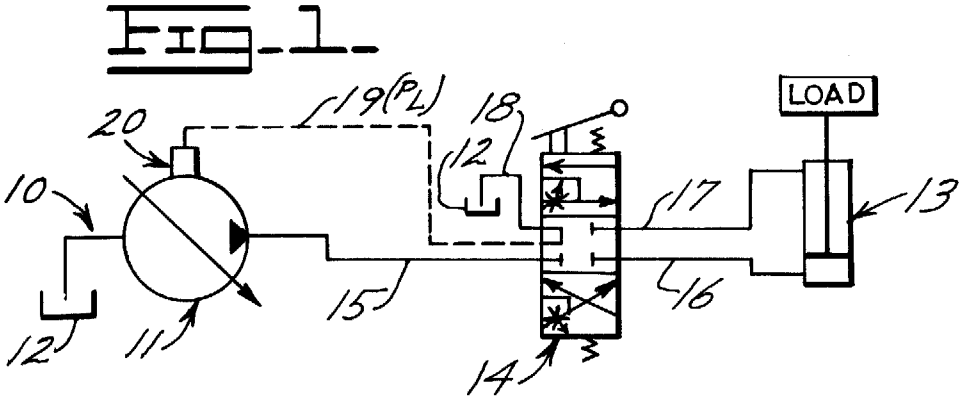
FIG. 1 schematically illustrates a fluid circuit employing an unloading means embodiment of the present invention therein for overriding the function of a "load-plus" valve.

FIG. 1 illustrates a fluid circuit 10 comprising a variable displacement pump 11 for communicating pressurized fluid from a reservoir or tank 12 to a fluid actuator 13 under the control of a standard directional control valve 14. The engine-driven pump may take the form of a hydraulic pump of the type shown in FIG. 2 of the drawings. In the illustrated fluid circuit, actuator 13 constitutes a double-acting hydraulic cylinder adapted for a variety of uses in a construction vehicle or the like in a conventional manner.

Upon downward shifting of directional control valve 14 in FIG. 1, the head end of cylinder 13 will be pressurized via lines 15 and 16, whereas the rod end thereof will be vented to tank 12 via lines 17 and 18. Upward shifting of directional control valve 14 will pressurize the rod end of cylinder 13 via lines 15 and 17 and exhaust the head end of the cylinder via lines 16 and 18. When either the head or rod end of the cylinder is pressurized with hydraulic fluid, a line 19 will communicate a load pressure signal $P_L$ to a servo-system 20 associated with pump 11.

Figure 2:
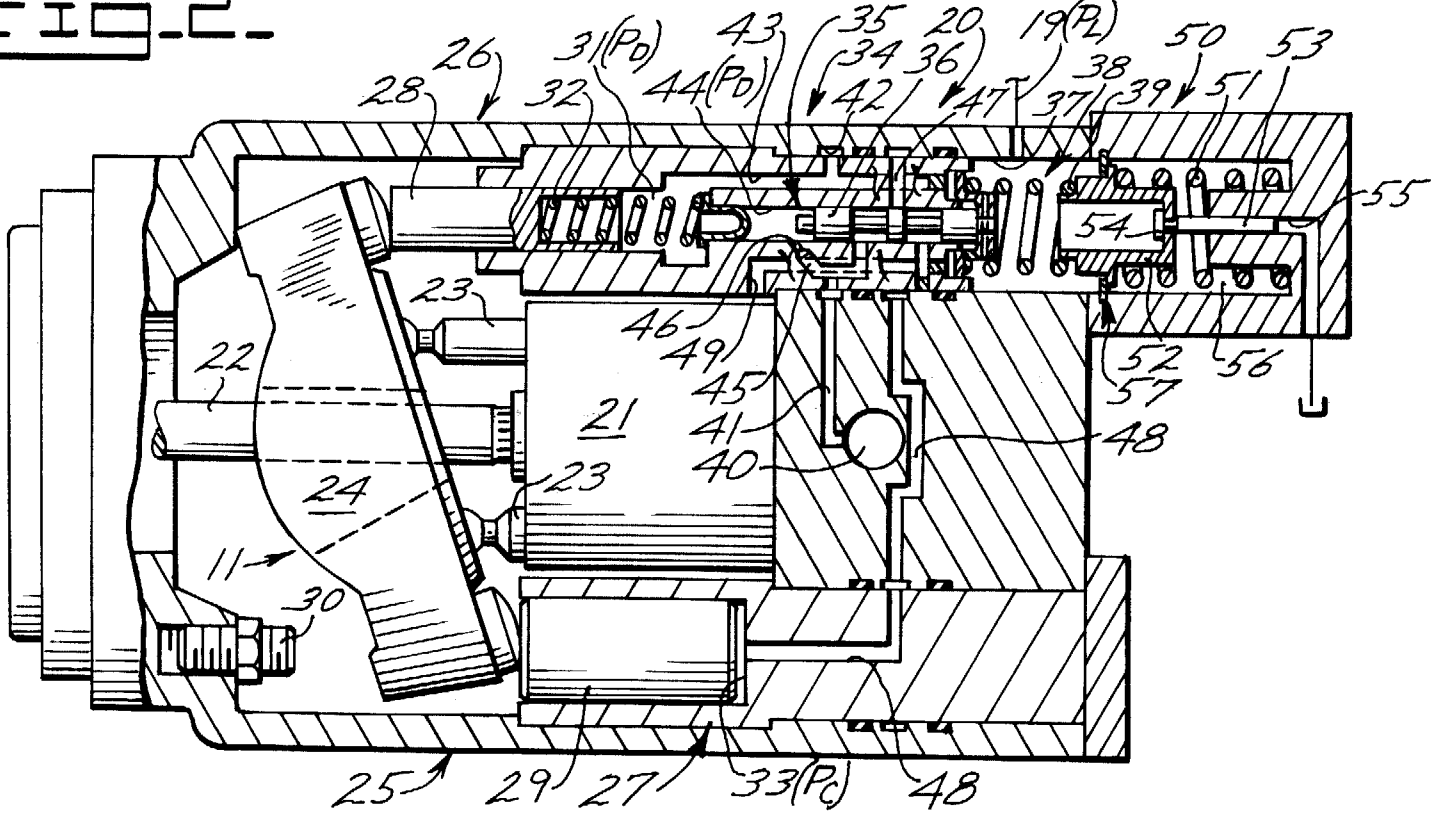
FIG. 2 is a longitudinal sectional view illustrating the unloading means and "load-plus" valve associated with a pump.

Referring to FIG. 2, pump 11 includes a barrel 21 adapted to be driven by an output shaft 22 of an engine, a plurality of reciprocal pistons 23 connected to a control member or swash plate 24, and a housing 25 enclosing the pump assembly. The displacement of pump 11 is determined by the rotational orientation of swash plate 24, having opposite sides thereof connected to first and second biasing means 26 and 27, respectively, which are interrelated by pistons 28 and 29. In the position illustrated, swash plate 24 will effect maximum pump displacement, whereas vertical orientation of the swash plate in FIG. 2 will effect zero or minimum displacement of the pump upon engagement of the swash plate with an adjustable stop 30.

First biasing means 26 may be considered to comprise a pressurized chamber 31 and a compression coil spring 32 contained in the chamber, the additive forces of the spring and the fluid pressure in chamber 31 functioning to urge swash plate 24 towards its first or maximum displacement position. Second biasing means 29 may be considered to comprise a pressurized control chamber 33, behind piston 29, which is adapted to have a control pressure $P_C$ varied therein to control pump displacement in a manner hereinafter more fully explained. It should be noted in FIG. 2 that piston 29 has a substantially larger effective diameter than piston 28. It can thus be seen that first biasing means 26 will function to urge swash plate 24 towards its illustrated first or maximum displacement position, whereas second biasing means 27 will function to urge the swash plate towards its second or minimum displacement position in opposition to the first biasing means and in response to the variable control pressure $P_C$ in chamber 33.

Figure 3:
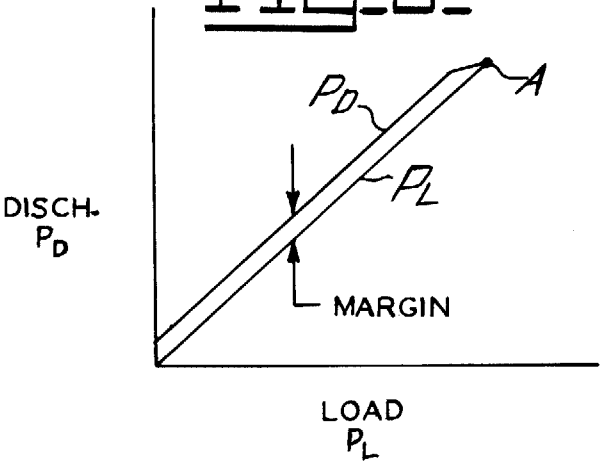
FIG. 3 graphically illustrates a margin or differential pressure, during the working range of the fluid circuit, between a pump discharge pressure $P_D$ and a load pressure signal $P_L$ generated in a fluid actuator.

As further shown in FIG. 2, servo-system 20 includes a flow-pressure compensated or "load-plus" valve 34 for maintaining pump discharge pressure $P_D$ in line 15 at a predetermined level above the required load pressure signal $P_L$ in line 19 and the active line 16 or 17, as depicted by the "MARGIN" in FIG. 3. "Load-plus" valve 20 includes a first means 35, having a spool 36, for varying control pressure $P_C$ in response to variations in discharge pressure $P_D$ of pump 11, and a second means or control chamber 37, for controlling the position of spool 36 to modulate the control pressure in response to variations in load pressure signal $P_L$ received from cylinder 13. A third biasing means 38, preferably in the form of a compression coil or margin spring 39, functions to maintain the above-mentioned pressure differential or "MARGIN" between the control pressure and the load pressure signal during a predetermined working range of fluid circuit 10.

"Load-plus" valve 34 functions similar to the corresponding valve disclosed in above-referenced U.S. Pat. No. 4,116,587. In particular, pump discharge pressure $P_D$ in a main discharge passage 40 communicates to chamber 31 of first biasing means 26 via a branch passage 41, an annulus 42, and a passage 43. Simultaneously therewith, pump discharge pressure will communicate to a chamber 44, behind spool 36, via a passage 45 having a restriction 46 therein for damping any pressure spikes in the system.

It can thus be seen that the fluid pressure in chamber 44, acting on the left end of spool 36 in FIG. 2, will be counteracted by the combined forces of spring 38 and the force generated by load pressure signal $P_L$ in chamber 37. This arrangement enables spool 36 to straddle a passage 47 and to controllably modulate between a position communicating pump discharge pressure from passage 41 to control chamber 33 via passage 47 and a passage 48, when the pump discharge pressure exceeds a predetermined level or a position venting chamber 33 to drain, via passages 48 and 47 and a drain passage 49 when the discharge pressure falls below such level. Pressurization of chamber 33, for example, will tend to pivot swash plate 24 clockwise in FIG. 2, towards its minimum displacement position, until pump discharge pressure has been lowered to return spool 36 to its straddling position. As mentioned above, margin spring 38 will function to maintain the desired pressure differential or "MARGIN" between the pump discharge pressure and the load pressure signal during the working range of the circuit, as depicted in FIG. 3.

This invention is generally directed to an unloading means 50 associated with load-plus valve 34 for inactivating margin spring 39 to reduce the pressure differential or margin between the pump discharge and load pressures to zero by unloading the force applied to spool 36 by the spring in response to the load pressure signal exceeding a maximum pressure level. This point, at which the biasing function of margin spring 39 is inactivated and the pump discharge pressure ($P_D$) and the load pressure signal ($P_L$) are at least substantially equalized, is depicted at point A in FIG. 3 of the drawings. As will be more fully appreciated hereinafter, unloading means 50 thus provides the advantages of minimizing horsepower losses by preventing needless loss of hydraulic fluid representing load pressure signal $P_L$ back to tank, and enables the unloading means to be constructed compactly whereby the overall pump package size may be kept small.

As further shown in FIG. 2, unloading means 50 comprises a biasing means or compression coil spring 51 mounted between housing 25 and a tubular retainer 52 which is disposed between springs 39 and 51. In addition, a piston 53, having a head 54, is attached to retainer 52 for simultaneous movement therewith and is slidably mounted in a bore 55 which further defines a drain passage. It should be noted that there are sufficient clearances between the attachment point of piston 53 with retainer 52 to permit hydraulic fluid in chamber 37 to pass into a spring chamber 56 for spring 51.

A stop means 57, shown in the form of a snap ring, is attached in housing 25 to limit leftward movement of retainer 52 in FIG. 2 and the preload of springs 39 and 51.

Thus, the fluid pressures on either side of the spring retainer are balanced and load pressure signal $P_L$ solely acts on the effective area of piston 53 for the purpose of moving the retainer rightwardly in FIG. 2 to compress spring 51, whereby the effective biasing force of margin spring 38 is relieved, when the load pressure signal exceeds a predetermined maximum pressure level, as indicated at A in FIG. 3. As will be appreciated by those skilled in the arts relating hereto, such inactivation of margin spring 39 will function to minimize horsepower losses by preventing needless loss of hydraulic fluid back to tank and to contain the total control package within a minimum envelope size.

Figure 4:
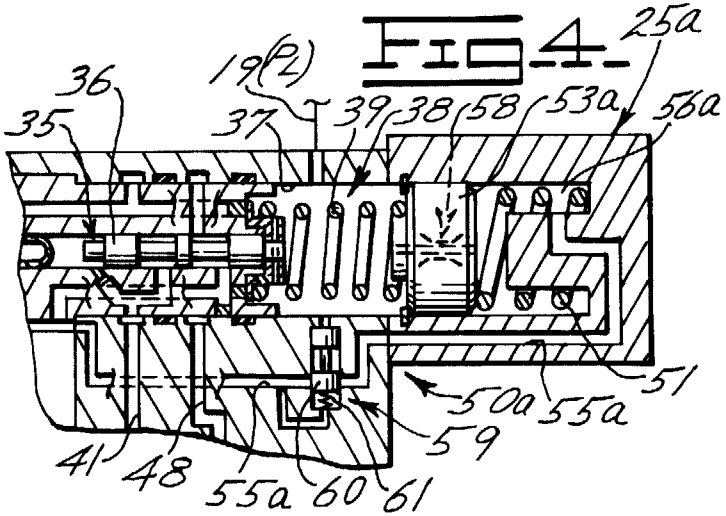
FIG. 4 is a sectional view illustrating a modification of the unloading means for the "load-plus" valve.

FIG. 4 illustrates a modified unloading means 50*a* wherein corresponding constructions are depicted by identical numerals, but with numerals depicting modified constructions being accompanied by an "a". Unloading means 50*a* comprises a biasing means or compression coil spring 51*a* mounted between a slightly modified housing 25*a* and a piston 53*a*, having a restricted passage 58 defined therethrough. A drain passage 55*a*, defined in housing 25*a*, communicates a spring chamber 56*a* for spring 51*a* with a shuttle valve 59, having a spool 60 which is normally biased to a closed position blocking drain passage 55*a* by a compression coil spring 61. It should be noted that restricted passage 58 communicates chamber 37 with chamber 56*a*, whereby the latter chamber will normally have load pressure signal $P_L$ prevalent therein during normal operation of the system.

However, when the load pressure signal exceeds a maximum pressure level, as indicated at point A in FIG. 3, shuttle valve 59 will move downwardly to open drain passage 55*a* to relieve the load pressure signal in chamber 56*a*. This will permit piston 53*a* to move rightwardly against the opposed biasing force of spring 51*a* to inactivate or relieve the force of margin spring 39, which is acting against spool 36. When the load pressure signal falls below such maximum pressure level, shuttle valve 58 will move upwardly to its closed position and piston 53*a* will move leftwardly to its modulating position to resume normal system operation.

INDUSTRIAL APPLICABILITY

Fluid circuit 10 of FIG. 1 finds particular application to hydraulic circuits for construction vehicles and the like wherein close and efficient control of one or more fluid actuators 13 is required for work purposes.

Referring to FIGS. 1 and 2, when the engine is shutdown with pump 11 inactivated, spring 32 will bias swash plate 24 towards its illustrated maximum displacement position and margin spring 39 will shift spool 36 leftwardly from its position shown in FIG. 2 to ensure drainage of chamber 33 via passages 48, 47, and 49. Upon starting-up of the engine to drive pump 11 and assuming that directional control valve 14 is in its neutral position illustrated in FIG. 1, load pressure signal $P_L$ in chamber 37 will be zero and thus, will have no effect on the positioning of modulating spool 36. Pump discharge pressure is communicated to chamber 31 via passages 41 and 43 and also to chamber 44, which tends to urge spool 36 rightwardly against the opposed force of margin spring 39.

Assuming that margin spring 39 is set at about 1400 kPa (203 psi), for example, pressurization of chamber 44 will modulate spool 36 to periodically communicate pump pressure from passage 41 to chamber 33, via passages 47 and 49, to pivot swash plate 24 towards its minimum displacement position to maintain system pressures equal to the margin setting and displacement sufficient to make up for any leakages that may occur in the circuit. When directional control valve 14 is shifted from its FIG. 1 neutral position to either extend or retract cylinder 13 under load, load pressure $P_L$ is communicated to chamber 37 to oppose the force of pump discharge pressure in chamber 44. So long as the circuit is working within its preselected range of operating pressures, modulating spool 36 of load-plus valve 34 will control the position of swash plate 24 and thus, pump discharge pressure in a conventional manner, as depicted by the parallel relationship of pressure curves $P_D$ and $P_L$ in FIG. 3.

However, when load pressure $P_L$ exceeds a predetermined maximum pressure level in chamber 37, such as 27,600 kPa (4003 psi), retainer 52 will be moved rightwardly in FIG. 2 by piston 53 to compress spring 51. The force of margin spring 39, applied to modulating spool 36, will thus be relieved to permit pump discharge pressure $P_D$ in chamber 44 and load pressure $P_L$ in chamber 37 to at least substantially equalize, as depicted at point A in FIG. 3, whereby further pressurization of cylinder 13 is prevented. Any further increase in the fluid pressure level in chamber 44 will function to shift modulating spool 36 rightwardly to pressurize chamber 33, whereby swash plate 24 will be pivoted clockwise in FIG. 2 towards its minimum displacement position.

It should be noted that resumption of normal operation of fluid circuit 10 may be initiated with no appreciable loss of load pressure signal $P_L$ in chamber 37, whereby horsepower losses of the system are minimized. As further suggested above, the provision of unloading means 50 aids in maintaining the total control package within a minimum envelope size to provide obvious advantages over prior art systems of this type.

As further explained above, modified unloading means **50*a* of FIG. 4 will function substantially identically to above-described unloading means 50. However, since only chamber 56*a* is vented when load pressure $P_L$ in chamber 38 exceeds a maximum pressure level, via shuttle valve 59, a minimal fluid loss occurs. Such loss is negligible and will not result in any appreciable horsepower loss. In the example wherein it is desirable to inactivate margin spring 39** when the load pressure signal exceeds 27,600 kPa, shuttle valve spring would be preloaded at such pressure.

Other aspects, objects, and advantages of this invention can be obtained from a study of the drawings, the disclosure, and the appended claims.

I claim:

1. In a fluid circuit (10) having a fluid actuator (13), a variable displacement pump (11) including a control member (24) movable between first and second displacement positions, first biasing means (26) for urging said control member (24) towards its first displacement position, second biasing means (27) for urging said control member (24) towards its second displacement position in opposition to said first biasing means (26) and in response to a variable control pressure ($P_C$), first means (35) for varying said control pressure ($P_C$) in response to variations in the discharge pressure ($P_D$) of said pump (11), second means (37) for controlling said first means (35) to modulate said control pressure ($P_C$) in response to variations in a load pressure signal ($P_L$) received from said fluid actuator (13), and third biasing means (38) for applying a margin force to said first means (35) to maintain a pressure differential between said pump discharge pressure ($P_D$) and said load pressure signal ($P_L$) during a predetermined range of said load pressure signal ($P_L$), the improvement comprising:

unloading means (**50/50*a*) for unloading the margin force applied to said first means (35) in response to said load pressure signal ($P_L$) exceeding a maximum pressure level and for inactivating said third biasing means (38**) to at least substantially equalize said pump discharge pressure ($P_D$) and said load pressure signal ($P_L$) in response to said unloading.

2. The fluid circuit (10) of claim 1 wherein said unloading means (**50/50*a*) includes a piston (53/53*a***).

3. The fluid circuit (10) of claim 2 wherein said unloading means (**50/50*a*) further includes spring means (51/51*a*) for normally biasing said third biasing means (38) and applying said margin force to said first means (35) and for being compressed by said piston (53/53*a***) in response to said load pressure signal ($P_L$) exceeding said maximum pressure level.

4. The fluid circuit (10) of claim 3 further including a retainer (52) disposed between said third biasing means (38) and said spring means (51) and wherein said retainer (52) is attached to said piston (53).

5. The fluid circuit (10) of claim 4 further including stop means (57) for limiting movement of said retainer (52) toward said third biasing means (38).

6. The fluid circuit (10) of claim 3 wherein said piston (**53*a*) is disposed between said third biasing means (38) and said spring means (51*a*) and further including an orifice (58) defined through said piston (53*a*), a chamber (56*a*) defined at one side of said piston (53*a*), a drain passage (55*a*) in fluid communication with said chamber (56*a*), and shuttle valve means (59) for opening said drain passage (55*a***) in response to said load pressure signal ($P_L$) exceeding said maximum pressure level.

7. A fluid circuit (10) comprising a source of pressurized fluid, including a variable displacement pump (11) having a control member (24) movable between first and second displacement positions, a fluid actuator (13), a directional control valve (14) interconnected between said pump (11) and said actuator (13), first biasing means (26) for urging said control member (24) towards its first displacement position, second biasing means (27) for urging said control member (24) towards its second displacement position in opposition to said first biasing means (26) and in response to a variable control pressure ($P_C$) in a control chamber (33) thereof, a "load-plus" valve (34) including modulating valve means (36) for modulating communication of pressurized fluid from said pump (11) to said control chamber (33), and third biasing means (38) for applying a force to said modulating spool means (36) and maintaining a pressure differential between pump discharge pressure ($P_D$) and said load pressure signal ($P_L$) during a predetermined range of said load pressure signal ($P_L$), and unloading means (**50/50*a*) for unloading the force applied to said modulating valve means (36) in response to said load pressure signal ($P_L$) exceeding a maximum pressure level and for inactivating said third biasing means (38**) to at least substantially equalize said pump discharge pressure ($P_D$) and said load pressure signal ($P_L$) in response to said unloading.

8. The fluid circuit (10) of claim 7 wherein said unloading means (**50/50*a*) includes a piston (53/53*a***).

9. The fluid circuit (10) of claim 8 wherein said unloading means (**50/50*a*) further includes spring means (51/51*a*) for normally biasing said third biasing means (38) and applying said margin force to said modulating valve means (36) and for being compressed by said piston (53/53*a***) in response to said load pressure signal ($P_L$) exceeding said maximum pressure level.

10. The fluid circuit (10) of claim 9 further including a retainer (52) disposed between said third biasing means (38) and said spring means (51) and wherein said retainer (52) is attached to said piston (53).

11. The fluid circuit (10) of claim 10 further including stop means (57) for limiting movement of said retainer (52) toward said third biasing means (38).

12. The fluid circuit (10) of claim 9 wherein said piston (**53*a*) is disposed between said third biasing means (38) and said spring means (51*a*) and further including an orifice (58) defined through said piston (53*a*), a chamber (56*a*) defined at one side of said piston (53*a*), a drain passage (55*a*) in fluid communication with said chamber (53*a*), and shuttle valve means (59) for opening said drain passage (55*a***) in response to said load pressure signal ($P_L$) exceeding said maximum pressure level.

* * * * *